United States Patent [19]

Pregenzer

[11] Patent Number: 4,731,562

[45] Date of Patent: Mar. 15, 1988

[54] ELECTROHYDRODYNAMICALLY DRIVEN LARGE-AREA LIQUID ION SOURCES

[75] Inventor: Arian L. Pregenzer, Corrales, N. Mex.

[73] Assignee: The United States of America as represented by the Department of Energy, Washington, D.C.

[21] Appl. No.: 867,175

[22] Filed: May 27, 1986

[51] Int. Cl.[4] ..... H01J 27/02

[52] U.S. Cl. ..... 315/111.81; 315/111.01; 313/328; 313/311; 313/232; 313/172; 313/362.1; 313/163

[58] Field of Search ..... 315/111.81, 111.01; 313/328, 311, 232, 172, 362.1, 163

[56] References Cited

U.S. PATENT DOCUMENTS

| | | | |
|---|---|---|---|
| 2,902,618 | 9/1959 | De Lany et al. | 313/163 |
| 3,084,629 | 4/1963 | Yevick | 103/1 |
| 3,533,910 | 10/1970 | Hirsh | 176/1 |
| 4,088,919 | 5/1978 | Clampitt et al. | 313/362.1 |
| 4,318,029 | 4/1982 | Jergenson | 315/111.81 |
| 4,318,030 | 3/1982 | Jergenson | 315/111.81 |
| 4,328,667 | 5/1982 | Valentian et al. | 60/202 |
| 4,367,429 | 1/1983 | Wang et al. | 313/232 |

OTHER PUBLICATIONS

Abramyan et al, "Megavolt Energy-Concentration Device," *Soviet Physics,* May 1972, vol. 16, No. 11, pp. 983-985.

Clampitt et al, "Molten Metal Field Ion Sources," *Inst. Phys. Conf. Ser.,* 38, Chapter 1, 1978.

Hendricks et al, "Field Emitted Ion Beams from Liquids for Electric Thrustors," *AIAA,* 18, 1973, pp. 295-300.

Bartoli et al, "A Liquid Caesium Field Ion Source Space Propulsion," J. Phys. D; *Appl Phys.,* 17, 1984, pp. 2473-2483.

*Primary Examiner*—David K. Moore
*Assistant Examiner*—Michael J. Nickerson
*Attorney, Agent, or Firm*—Armand McMillan; James H. Chafin; Judson R. Hightower

[57] ABSTRACT

A large-area liquid ion source comprises means for generating, over a large area of the surface of a liquid, an electric field of a strength sufficient to induce emission of ions from a large area of said liquid. Large areas in this context are those distinct from emitting areas in unidimensional emitters.

17 Claims, 3 Drawing Figures

ELECTROHYDRODYNAMICALLY DRIVEN LARGE-AREA LIQUID ION SOURCES

The U.S. Government has rights in this invention pursuant to Contract No. DE-AC04-76DP00789 between the U.S. Department of Energy and AT&T Technologies, Inc.

BACKGROUND OF THE INVENTION

This invention relates to novel large area sources of ions and methods for producing them.

Extraction of a single ion beam from liquid metals is a common procedure. However, up to this point liquids have not been used to produce large-area ion beams.

Liquid-metal ion sources usually consist of a capillary filled with a liquid metal or a small radius needle that is wetted with a liquid metal. M. D. Gabovich, *Sov. Phys. Usp.* 26, 447 (1983); U.S. Pat. No. 4,318,029; U.S. Pat No. 4,318,030; and Hendricks, et al., AIAA, Vol. 18, 1973, pp. 295–300. The liquid metal serves as an anode to which an extracting voltage is applied. Ion emission from a sharp edge wetted liquid metal (edge emitter) has also been reported. R. Clampitt and D. K. Jefferies, LEIB I, Salford, *Inst. Phys. Conf. Ser.* 38, Chap. 1 (1978). The liquid metal deforms under the competing effects of surface tension and electrostatic stress. When the applied field is high enough, the liquid metal at the tip of a needle or capillary is drawn up into a cusp. G. Benassayag, P. Sudraud and B. Jouffrey, *Ultramicroscopy* 16, 1 (1985). Cusps also form along the razor edge of the edge emitter. Clampitt et al, supra. The electric field in the vicinity of the cusps is greatly enhanced and field evaporation of ions occurs.

A similar ion source is disclosed in U.S. Pat. No. 4,328,667. This system involves the field-emission of ions from a liquid through a very narrow slit. See also, Bartoli et al, *J. Phys. D: Appl. Phys.* 17 (1984), pp. 2473–2483. Like the above-mentioned devices, the devices of these references are essentially unidimensional. Two-dimensionality is attempted by simple stacking of the one dimensional devices. However, for many applications, the resultant current density is much too low, e.g., for fusion applications, e.g., as discussed in U.S. Pat. No. 3,533,910, with respect to lithium ion sources. Furthermore, of course, these prior art devices are not true two dimensional devices, i.e., large surface area devices.

Heretofore, there has been no suggestion of whether or how true two dimensional ion generation from suitable liquid sources may be achievable in practice. Such large-area sources would satisfy the still existing need, e.g., for high density, preferably tunable, ion current devices. For special applications, e.g., for the light ion-beam driver needed for inertial confinement fusion, whether such devices, even if they were available, would successfully provide the required current densities, (e.g., on the order 5 kA/cm$^2$) in the required very fast growth times (e.g., on the order of 1.0 ns), is unpredictable.

SUMMARY OF THE INVENTION

Accordingly, it is an object of this invention to provide a large area, two dimensional, liquid source of ions (e.g., cations such as metal ions), as well as a method of achieving large area liquid ion currents.

It is a further object of this invention to provide such a source which satisfies the stringent conditions for a light ion-beam driver for inertial confinement fusion.

Upon further study of the specification and appended claims, further objects and advantages of this invention will become apparent to those skilled in the art.

These objects have been achieved by providing a large-area liquid ion source comprising means for generating, at the surface of a liquid capable of emitting ions, an electric field of a strength sufficient to induce emission of ions from a large area of said liquid.

They also have been achieved by providing a device for generating a current of ions comprising:

a cathode (of unspecified geometry);

an anode separated from said cathode by a gap and having a surface which faces said cathode;

a source of ions forming at least part of said anode surface facing said cathode;

means for maintaining said ion source in the liquid state;

means for generating an electric field between said anode and cathode whereby the electric field at said liquid ion source surface is of sufficient strength that ions are emitted from a large area of said anode surface independently of electrons field emitted from said cathode.

They have further been achieved by providing a method of generating a current of cations from a large area of the surface of a liquid comprising subjecting the surface to an electric field of sufficient strength to generate said current from said large area. The current of this invention is uniform (e.g., with respect to the area of the surface) and is pure where desired, depending on the composition of the liquid.

In certain other exemplary aspects, these objects have been achieved by providing the foregoing aspects wherein the ions are metal ions, preferably lithium ions, derived from liquid metal or metal salt sources. In further preferred aspects, the applied electric fields have strengths on the order of 10 MV/cm or more (typically, producing enhanced local fields at the cusps discussed below on the order of 100 MV/cm or more) and the resultant current density is on the order of at least about 5 kA/cm$^2$.

BRIEF DESCRIPTION OF THE DRAWINGS

Various other objects, features and attendant advantages of the present invention will be more fully appreciated as the same becomes better understood when considered in connection with the accompanying drawings, in which like reference characters designate the same or similar parts throughout the several views, and wherein.

DETAILED DISCUSSION

For this invention, the term "large area" is used to distinguish the liquid ion sources and related devices of this invention from the point and one dimensional sources available from the prior art. In general, where an unstable surface wave (discussed further below) is of a wavelength λ, then the point emitters in the "large area" will be separated from one another by a distance substantially equal to this wavelength. "Large area" in the context of this invention is an area significantly greater than $\lambda^2$, e.g., $10\lambda^2$, $100\lambda^2$, etc. For many applications, "large area" will mean areas on the order of 0.001 $cm^2$, 0.01 $cm^2$, 0.1 $cm^2$, 1 $cm^2$, 10 $cm^2$, 100 $cm^2$, 1000 $cm^2$, etc., much smaller and/or larger values being applicable in particular instances. The important point is that the sources of this invention are not unidimensional as in all prior art systems. Rather, the emission of this invention is from a plurality of closely spaced, essentially point source emitters separated by distances on the order of the wavelength of the perturbation.

This invention is applicable to essentially any liquid from which ions can be evaporated. It is applicable to elemental metals, metallic alloys, metallic salts, and any other similar liquid, e.g., water and many others. It is equally applicable to non-ionic liquids, e.g., non-polar organic substances, e.g., oils and the like. The ion produced need not be present in the liquid in the ionic form. Ionic fragments can be generated during the experiment.

The basic requirement is that the liquid forms at least a portion of the surface of an anode and that the field applied to the anode be greater than the minimum field discussed below. The preferred metal ion for this invention is lithium because the preferred application of the source of this invention is in inertial confinement fusion. However, this invention is applicable to a wide variety of ion beams. In essence, this invention can be utilized to generate an ion beam for use in essentially any conventional application employing ion beams as long as a corresponding liquid source is available which produces the ions of interest during the experiment and charge separation can be achieved upon application of a strong electric field. Other suitable metal ions include other alkali metal ions such as sodium, potassium, cesium, etc., cations normally employed in semiconductor doping, e.g., boron, gallium, arsenic, phosphorous, etc., transition metals, and the like. This listing is only exemplary. Thus, this invention can be used as a replacement for prior art ion sources in general, both for positive ions (cations) and negative ions (anions). Where negative ions are achieved, of course the cathode takes the place of the anode discussed herein above and below. It may be necessary to employ fully conventional magnetic insulation procedures to separate electrons produced from the cathode from the desired negative electrons produced.

Figure 1C:
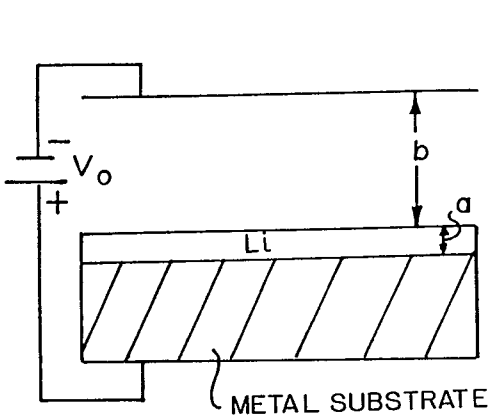
FIG. 1 shows some of the many anode configurations which can be used in conjunction with this invention.
Figure 1B:
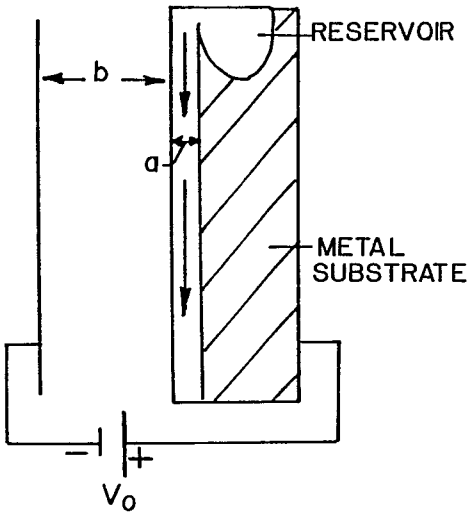
Figure 1A:
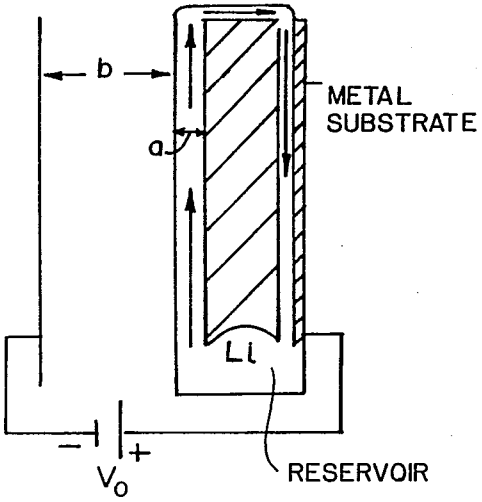

Essentially any configuration can be utilized for the anode of this invention. It is only necessary that the configuration be amenable to the maintenance of the cation source in liquid form at the surface of and in electrical contact with the anode. A variety of these is shown in FIG. 1. In FIG. 1(*c*) is shown a simple configuration wherein the anode surface is simply made horizontal and in direct opposition to the corresponding cathode surface. The lithium or other source can be fully conventionally heated to its melting point and beyond by any fully conventional technique, including conductive, inductive, radiative, etc., heating methods. Of course, where the source is normally liquid under ambient conditions of the practice of the invention, the means for liquid maintenance of this invention can be constituted, e.g., by the means necessary to prevent unwanted gravity flow, etc.

In FIG. 1(*a*), advantage can be taken of the wicking behavior of various liquids. The liquid wicks up along the surface of the anode substrate, forming a liquid metal surface, e.g., planar, in opposition to the cathode surface. A return path to the reservoir replenishes the supply of liquid. This has the advantage of producing a cleansing effect due to the circulation of Li. Contaminants which react strongly with Li are removed from the systems as the liquid circulates. This will greatly further purify the ion beam. In FIG. 1(*b*), gravity is used to pull the liquid down from an upper reservoir along the front surface of the anode.

Many other configurations are possible. In addition, the anode and/or cathode can take on any appropriate shape; preferably, the anode will be shaped to focus the resultant ion beam at a desired location. Thus, the anode can have a cylindrical or other concave shape in order to focus the beam at a point, along the line, etc. The cathode need not be planar.

All surfaces which come in contact with the liquid, of course, must be inert to it on the time scale of interest. Preferably, the substrate which holds the liquid surface will be highly conductive in order to maximize the electric field at the surface of the liquid. This is not a necessity for lithium liquids or conducting compounds containing lithium, e.g., $LiNO_3$. Suitable substrate conductors are known and include for Li the base metals niobium, molybdenum, rhenium, etc., alloyed with titantium, chromium, zirconium, etc. (Smith et al, *Nuclear Technology,* 22, 392 (1974)). Preferred at the present time for Li are pure iron and 304 stainless steel and quartz for $LiNO_3$.

It is also possible to obtain a liquid surface on an anode by more conventional means such as simple dipping or other application means, e.g., spraying (where applicable), spreading (where applicable), etc. For example, an especially preferred anode substrate for use in conjunction with lithium sources is a stainless steel frit. This substrate can be utilized in accordance with this invention especially easily, e.g., by simply dipping it into liquid lithium.

The thickness of the liquid surface layer on the conductive anode substrate (where present) is not critical. The thickness must be large enough that the layer acts as a normal liquid rather than as a monolayer. Typically, 10–100 or more monolayers will suffice for liquid behavior. In addition, the thickness of the liquid should be greater than the wavelength of the surface wave which characterizes the particular conditions involved. For most of the exemplary work reported below, at a liquid thickness of about 10 mm, the liquid for all intents and purposes is of infinite thickness for electric fields as large as those discussed below. Of course, there is no theoretical upper limit on suitable liquid thicknesses. Practical considerations will routinely and conventionally determine this aspect.

Similarly, there is no criticality to the gap between the anode and the cathode. Typically, this will simply be adjusted to obtain the desired electric field with the electrical configuration being utilized. The gap serves as a customary adjustment parameter as in other cathode/anode systems. For essentially any practical gap there will be a voltage above which the instability necessary to achieve the effects of this invention will be obtained. The larger the gap, the larger the applied voltage which will be necessary. In addition, of course, the wavelength of the dominant surface wave will vary as a function of the gap and the voltage.

The critical field necessary to achieve the instability producing the effects of this invention will vary with the specific details involved, e.g., liquid density, liquid surface tension, liquid viscosity, electrical configuration, ion identity, vacuum level, etc. For any given case, the minimum field necessary can be easily determined by a few routine preliminary experiments. Typically, the field will be on the order of 10 kV/cm or more, but can vary to significantly lower or higher values in dependence upon the above parameters.

The vacuum between the anode and the cathode will also be chosen in accordance with conventional considerations. Typically, it must be sufficiently low that ionization of the residual gas or liquid vapor by the applied electric field is avoided. There must be no breakdown at local electric fields. Vacuums on the order of $10^{-5}$ torr or lower will usually suffice. Preferably, the lower the better. For example, for many situations, it will be preferred to operate with lithium nitrate rather than lithium metal since the former is easier to handle and maintain in an uncontaminated state, e.g., due to oxide formation in the case of Li. As a result, the vacuum requirements for lithium nitrate are probably easier to achieve than are those for lithium. The latter oxidizes much more readily and becomes contaminated much more readily. Conventional considerations of this sort will be used in an individual case to determine parameters such as vacuum pressure.

The nature of the cathode will be completely noncritical as long as it is compatible with the other operating features of the invention. Various other aspects and details of carrying out this invention will be in accordance with prior art field emission systems unless indicated otherwise herein, e.g., in accordance with the details of the several references mentioned herein, all of which are incorporated by reference.

To further demonstrate this invention, the behavior of a planar, large area liquid-conducting surface in the presence of a high electric field has been investigated using a model where the anode consists of a liquid conductor of depth a. A planar cathode, at voltage $-V_0$ with respect to the anode, is situated at a distance b from the surface of the liquid metal. The electrohydrodynamic (EHD) equations of motion and the appropriate boundary conditions for this system are given in Table 1.

TABLE 1

Electrohydrodynamic equations of motion and boundary conditions for a planar liquid metal in an electric filed. The free surface is described by $z = \xi(x,y,t)$; v is the liquid velocity, n is the unit normal to the surface, p is the pressure, $\tilde{M}$ is the stress tensor, $R_{1,2}$ are the principle radii of curvature of the liquid surface. Other variables are defined in the text. The symbol [ ] denotes the difference in the enclosed quantity across an interface separating two different materials.
$[M_{\alpha\beta}] = \delta_{\alpha\beta}T(R_1^{-1} + R_2^{-1}) - [\epsilon E_\alpha E_\beta - \frac{1}{2}\epsilon\delta_{\alpha\beta}E_\gamma E_\gamma]$.

| Equation | Description |
|---|---|
| Bulk equations | |
| $\nabla \cdot v = 0$ | continuity equation |
| $\rho\left(\frac{\partial v}{\partial t} + (v \cdot \nabla)v\right) + \nabla p = \rho g$ | conservation of momentum |
| $\nabla \times E = 0$ | |
| $\nabla \cdot \epsilon E = 0$ | no bulk charge |
| Boundary conditions at $\xi$ | |
| $n \cdot [v] = 0$ | continuity of normal velocity |
| $n_\alpha[p] - n_\beta[M_{\alpha\beta}] = 0$ | balance of stress |
| $n \times [E] = 0$ | continuity of tangential E |
| Boundary conditions at electrodes | |
| $(n \times E)_{z=-a,b} = 0$ | conducting electrodes |
| $(n \cdot v)_{z=-a,b} = 0$ | rigid electrodes |

A first-order solution of the equations of motion shows that waves will develop on the liquid-metal surface due to the interaction of the surface charge with the electric field (electric stress), and the effects of surface tension and gravity. The dispersion relation between the frequency $\omega$ and the wave number k for surface waves is $$\omega^2(x) = \frac{T}{\rho b^3} x\tanh(\alpha x)\left(x^2 + \frac{\rho g b^2}{T} - \frac{\epsilon_o E_o^2 b}{T} x\coth(x)\right), \quad (1)$$

where $E_0 = V_0/b$, $x = kb$, $\alpha = a/b$, T is the surface tension and $\rho$ is the density of the liquid metal, g is the gravitational acceleration, and $\epsilon_0$ is the permittivity of free space. For a detailed discussion of this phenomenon, see J. R. Melcher, *Field-Coupled Surface Waves* (M.I.T., Cambridge, MA, 1963). For values of $V_0$ and b which are typical of the diodes used at Sandia ($V_0/b$ $10^6$–$10^7$ volts/cm) gravitational effects are negligible.

Figure 2:
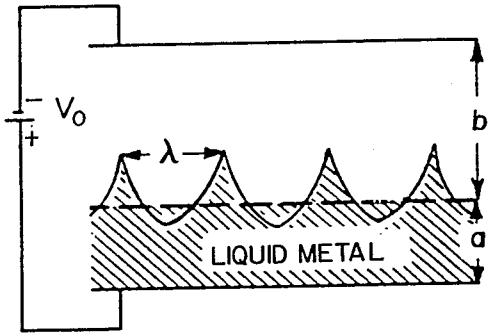
FIG. 2 is a schematic drawing of the distorted surface structure caused by unstable growth in high electric field. The equilibrium surface is given by the dashed line.

When the applied field $E_0$ is greater than a critical value $E_c$ (readily obtainable for electric fields obtainable for $V_0$ and b values mentioned above), there exists a range of unstable wave numbers, corresponding to negative values of $\omega^2$. Instabllities cause the surface perturbations to distort into a sharply peaked structure as is represented schematically in FIG. 2. The pointed structures on the surface wave have the effect of greatly enhancing the electric field in their vicinity. Scanning and transmission electron micrographs of such structures on point liquid metal ion sources can be found in the first three references mentioned above. When the enhanced electric field exceeds a value of approximately 100 MV/cm, field vaporation of ions from the liquid surface will occur. R. Gomer, *Appl. Phys.*, 19, 365 (1979).

For a large area source the unstable wave with the largest growth rate should dominate the length and time scales of the surface dynamics. The emitter density and the time needed to achieve ion emission will depend on the wavelength $\lambda$ and growth rate $\tau$, respectively, of the dominant mode, where $\lambda = 2\pi/k$ and $\tau = 1/\mathrm{Re}(\omega)$.

The value of x corresponding to the maximum growth rate can be calculated by differentiating the dispersion relation with respect to x and equating it to zero. It should be noted that the unperturbed field at the surface of the liquid metal is on the order of $10^7$ volts/cm, and so even very small distortions in the surface will produce field enhancement sufficient to start ion desorption.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

EXAMPLE

PBFA II, SAndia's advanced light-ion accelerator, will deliver a 30 million volt, 5 million ampere lithium ion beam to a marble-sized inertial confinement fusion (ICF) target filled with isotopes of hydrogen. Although most light ion ICF experiments have been performed with proton beams, lithium ions have been selected for use on PBFA II because of their greater focusability. This greater focusability results in higher intensity beams for $Li^+$than for protons. Using lithium ions, PBFA II has the potential of reaching the scientific break-even point where the thermonuclear energy released from the fusion reaction is equal to the ion beam energy absorbed.

High power ion diodes have been studied for several years as inertial confinement fusion (ICF) drivers. Considerations of beam focusability, as mentioned, target interaction physics, and compatibility with pulsed power technology have made singly ionized lithium, electrostatically accelerated to an energy of 30 MeV, the ion of choice. J. P. VanDevender, *Proceedings of the Fifth International Conference on High-Power Particle Beams,* San Francisco, CA, Sept. 12–14, 1983, p. 17. Application of this invention shows that liquid lithium can provide an electrohydrodynamically driven ion source which uniformly produces ions on a nanosecond time scale.

To be useful as an ion source for ICF, the source must produce ions uniformly on a time scale short compared to the pulse width of the applied voltage in the ion diode. The Particle Beam Fusion Accelerator II (PBFA II) (D. L. Johnson, E. L. Neau and B. N. Turman, *Proceedings of the Fourth IEEE Pulsed Power Conference,* Albuquerque, NM (Texas Tech, Lubbock, Tex., 1983), p. 54), at Sandia National Laboratories, will have a pulse length of 20 ns. Since an ICF target should be irradiated for 10–20 ns, the growth time should be on the order of 1.0 ns. Beam focusability requires that the distance between emitters not exceed 0.2 mm. D. J. Johnson, E. J. T. Burns, M. P. Quintenz, K. W. Bieg, A. V. Farnsworth, Jr., L. P. Mix and M. A. Palmer, *J. Appl. Phys.*, 52, 168 (1981). In order to deliver sufficient power ($\sim$100 TW/cm$^2$) to the target, the ion current density must be of the order of 5 kA/cm$^2$ over an area of $\sim$800 cm$^2$. The source must also be able to operate in an applied magnetic field parallel to its surface. This magnetic field insulates the anode from electrons which are field emitted from the cathode. The addition of the magnetic field to the equations of motion produces a stabilizing effect in a direction parallel to the magnetic field for highly conducting liquids. There is no effect in the direction perpendicular to the magnetic field, however. In the case of highly conducting liquids, the distorted surface will have the appearance of cusp-like ridges parallel to the magnetic field. This is not expected to occur with liquid lithium or lithium nitrate due to their poor conductivities.

Figure 3A:
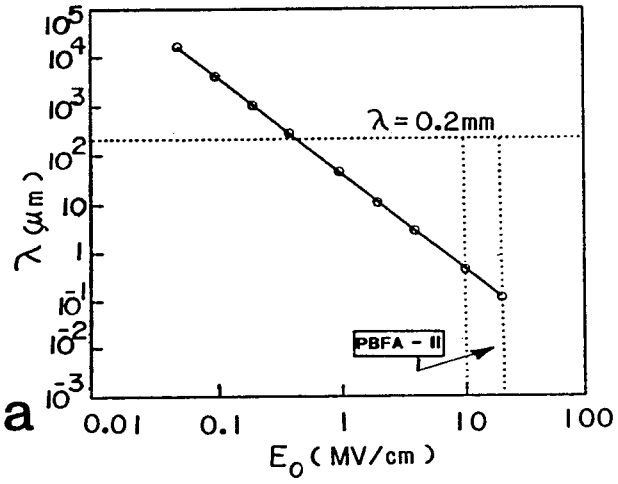
FIG. 3 shows wavelength $\lambda$ and growth time $\tau$ of the dominant instability as a function of the applied electric field $E_0$, for liquid lithium ($\rho$=0.515 g/cm$^3$, T=400 dyn/cm at the melting temperature 180° C.).
Figure 3B:
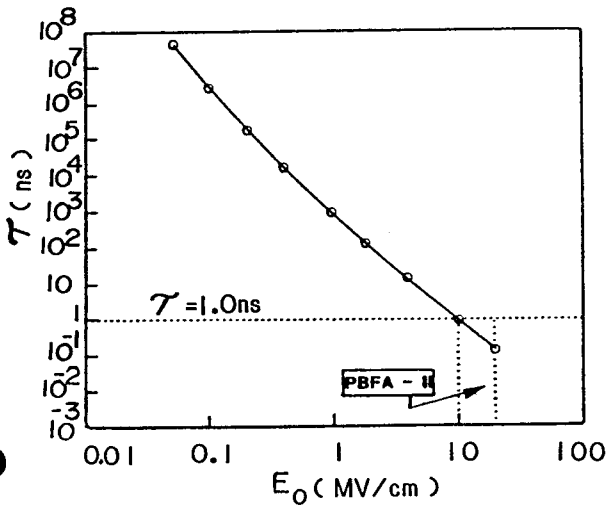

Values of the wavelength and growth time of the dominant instability have been calculated for liquid lithium as a function of the applied electric field and are shown in FIG. 3. Reference to the figure shows that for $E_0 > 10.0$ MV/cm, which is the regime pertinent to PBFA II, the ICF requirements of emitter density and growth time are met. For $E \geqq 10$ MV/cm the current per emitter required to obtain a current density of 5 kA/cm$^2$ (assuming an emitter density of $\lambda^{-2}$) is less than 10 $\mu$A. Since currents in the 1–300 uA range are routinely observed for liquid-metal capillary sources (Gomer, supra.), the emitter current requirement should be easily satisfied. Since the emitting region of a typical single liquid-metal ion source has dimensions which are much smaller than the distance between emitters of this invention (Benassayag, supra), adverse space charge effects on a given emitter due to neighboring emitters should not occur. This expectation is substantiated by the operation of the "edge" emitter described by Clampitt and the slit emitter described by Bartoli.

Further verification of these conclusions can be seen from the following. To first order, the amplitude of the electric field associated with a perturbation of wavelength $\lambda$ is given approximately by:

$$E = E_0[1 + \epsilon_0 k\, e^{t/\tau}] \qquad (2)$$

where $E_0$ is the applied field, $\epsilon_0$ is the initial (small) amplitude and $\tau$ is the e-folding time of the perturbation of wave number k. The quantity $\epsilon_0$ is one of the initial conditions of the problem; it is not a calculated quantity. Thus, the electric field at time $t = \tau$ depends on the amplitude of the initial perturbation from the equilibrium planar configuration. In perturbation theory, $\epsilon_0$ must be a small quantity when compared to other length scales.

Values of the wavelength and growth time of the dominant instability have been calculated for liquid lithium and liquid lithium nitrate for $0.05 \leqq E_0 \leqq 20.0$ MV/cm. The values are collected in Tables 2 and 3. Also shown in the table is i, the current per emitter needed to achieve 10 kA/cm$^2$, assuming an emitter density of $1/\lambda^2$. Reference to the tables again shows that for $E_0 \geqq 10.0$ MV/cm, which is the regime pertinent to PBFA II, the ICF requirements of emitter density is met for both liquids. The amount of time available for the instability to occur will depend on the voltage pulse width. Approximately three linear growth times are needed to produce field enhancement factors of 5. For $E_0 \geqq 10$ MV/cm the current per emitter required to obtain a current density of 10 kA/cm$_2$ is less than 20 $\mu$A. As noted, for liquid metal capillary sources, currents in the range 1.0–10$_2$ $\mu$A are routinely observed and so the emitter current requirement should not pose a problem. Fields in the 10.0–20.0 MV/cm range would seem to be ideal for the operation of liquid metal anodes.

TABLE 2

Liquid lithium: the wavelength, $\lambda$, and e-folding time, $\tau$, of the dominant instability as a function of the applied field, $E_o$. The quantities i and $E_o$ are the current per emitter needed to achieve 10 kA/cm$^2$ (assuming an emitter density of $1/\lambda^2$), and the amplitude of the initial perturbation needed to achieve E = 100 MV/cm at $t = \tau$, respectively. A perturbative treatment requires that $E_o << a, b$.

| $E_o$ (MV/cm) | $\lambda$($\mu$m) | $\tau$(ns) | i($\mu$A) |
|---|---|---|---|
| 20.0 | 0.11 | 0.11 | 1.1 |
| 10.0 | 0.43 | 0.9 | 18.3 |
| 4.0 | 2.64 | 14.2 | 697.0 |
| 2.0 | 9.72 | 152.0 | $9.5 \times 10^3$ |
| 1.0 | 42.8 | 950.0 | $1.8 \times 10^5$ |
| 0.4 | 264.0 | $1.4 \times 10^4$ | |
| 0.2 | 973.0 | $1.5 \times 10^5$ | |
| 0.1 | $3.8 \times 10^3$ | $2.3 \times 10^6$ | |
| 0.05 | $1.6 \times 10^4$ | $4.0 \times 10^7$ | |

TABLE 3

Same as Table 2, but for liquid lithium nitrate.

| $E_o$ (MV/cm) | $\lambda$($\mu$m) | $\tau$(ns) | i($\mu$A) |
|---|---|---|---|
| 20.0 | 0.03 | 0.06 | 0.1 |
| 10.0 | 0.12 | 0.45 | 1.4 |
| 7.0 | 0.24 | 1.3 | 5.7 |
| 6.0 | 0.33 | 2.1 | 10.9 |
| 5.0 | 0.47 | 3.6 | 22.1 |
| 4.0 | 0.73 | 7.1 | 53.3 |
| 3.0 | 1.3 | 16.8 | 169.0 |
| 2.0 | 2.9 | 56.8 | 841.0 |
| 1.0 | 11.7 | 454.0 | $1.4 \times 10^4$ |
| 0.5 | 46.9 | $3.6 \times 10^3$ | |
| 0.1 | $1.1 \times 10^3$ | $6.4 \times 10^5$ | |
| 0.05 | $4.0 \times 10^3$ | $1.0 \times 10^7$ | |

A key practical requirement for this application of the invention is to wet the metal anode surface with molten lithium metal. Many techniques are known for this purpose both with respect to lithium and other ions utilizable within the scope of the invention. Laboratory experiments have demonstrated that lithium wets suitable substrates within the confines of the conditions useful in initial confinement fusion.

From general considerations, it was known that the inclusion of viscous effects in the equations of motion would result in longer growth times and longer wavelengths for the dominant unstable surface wave and that the effect of viscosity on the dynamics of the dominant mode is more pronounced as the value of the applied electric field is increased. A linear analysis of the viscous fluid in the presence of an electric field has been performed. It has been shown that the effects of viscosity are inconsequential for this proposed application of the invention. Although the change in growth time is indeed a monotonically increasing function of the applied electric field it is quite small: ranging from 4 percent at 2.0 MV/cm to only 44 percent at 30 MV/cm. For example, at 20 MV/cm, without viscosity, the growth time of the most rapidly growing mode is 0.11 nsec. When viscous effects are included, the growth time increases by 35 percent to 0.17 nsec, which is still very small compared to the time available to produce cusp-like structures which are expected to emit ions.

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A liquid ion source comprising means for generating, over a large area of the surfae of a liquid capable of emitting ions, an electric field of a strength sufficient to induce emission of ions from said large area at a current density on the order of at least 5 kA/cm$^2$, wherein said large area is on the order of at least $10\lambda^2$ and $\lambda$ is the wavelength of an unstable surface wave generated in said ion source by said electric field.

2. A device for generating a current of positive ions with a density on the order of at least 10 kA/cm$^2$, comprising:

a cathode;

an anode separated from said cathode by a gap and having a surface which faces said cathode;

a liquid source of positive ions forming at least part of said anode surface facing said cathode;

means for maintaining said positive ion source in the liquid state;

means for generating an electric field between said anode and cathode, whereby the electric field at said liquid anode surface is of sufficient strength that positive ions are emitted from a large area of said surface, independently of field emitted electrons from said cathode, wherein said large area is on the order of at least $10\lambda^2$, $\lambda$ being the wavelength of an unstable surface wave generated in said ion source by said electric field.

3. A device of claim 2, wherein said ions are metal ions.

4. A device of claim 3, wherein said liquid ion source is a metal salt.

5. A device of claim 3, wherein said liquid ion source is a metallic element.

6. A device of claim 3, wherein said liquid ion source is metallic lithium or a lithium salt.

7. A device of claim 6, wherein said salt is lithium nitrate.

8. A device of claim 6, wherein said electric field is of a strength of at least 10 MV/cm.

9. A device of claim 3, wherein said electric field is of a strength of at least 10 MV/cm.

10. A device of claim 9, wherein the current density of the emitted cations is on the order of 5 kA/cm$^2$ or more.

11. A device of claim 2, wherein said anode is shaped to focus the emitted cations.

12. A device of claim 2, wherein said large area is about 1 cm$^2$ or more.

13. A device of claim 2, wherein said large area is about 100 cm$^2$ or more.

14. A method of generating a current of ions having a density on the order of at least 10 kA/cm$^2$ from an area of the surface of a liquid ion source, said area being on the order of at least $10\lambda^2$, $\lambda$ being the wavelength of an unstable surface wave generated in said ion source, comprising exposing the surface to an electric field of at least 10 MV/cm.

15. A method of claim 14, wherein the ions are positive ions.

16. A method of claim 15, wherein said large area is about 100 cm$^2$ or more.

17. A method of claim 15, wherein said ions are lithium ions.

* * * * *